United States Patent [19]

McGee

[11] Patent Number: 4,659,121

[45] Date of Patent: Apr. 21, 1987

[54] GARAGE DOOR LOCK SYSTEM

[76] Inventor: Michael H. McGee, 4620 Alla Rd., Los Angeles, Calif. 90066

[21] Appl. No.: 587,358

[22] Filed: Mar. 8, 1984

[51] Int. Cl.[4] ..... E05C 1/04

[52] U.S. Cl. ..... 292/144; 292/DIG. 53

[58] Field of Search ..... 292/144, 145, 148, 162, 292/67, 68, DIG. 53; 70/279

[56] References Cited

U.S. PATENT DOCUMENTS

| | | | |
|---|---|---|---|
| 113,377 | 4/1871 | Wheeler | 292/68 |
| 608,321 | 8/1898 | Carleton | 292/144 |
| 635,352 | 10/1899 | Sawtelle | 292/67 X |
| 1,036,583 | 8/1912 | Diedrich | 292/162 |
| 2,794,663 | 6/1957 | Grodt et al. | 292/67 |
| 2,815,796 | 12/1957 | Lobanoff | 292/144 X |
| 2,872,233 | 2/1959 | Bordner | 292/148 X |
| 3,166,144 | 1/1965 | Price | 292/144 X |
| 4,021,063 | 5/1977 | Porter | 292/67 |
| 4,254,582 | 3/1981 | McGee | 292/144 X |
| 4,277,094 | 7/1981 | Roue | 292/144 X |
| 4,372,419 | 2/1983 | Barnett et al. | 292/144 X |

*Primary Examiner*—Richard E. Moore

*Attorney, Agent, or Firm*—Freilich, Hornbaker, Rosen & Fernandez

[57] ABSTRACT

A garage door lock system is described which resists prying open while facilitating authorized opening of the system in the event of a power failure or other malfunction. The system includes a lock box (16) fastened to a door frame, and a solenoid (22) mounted in the box. The solenoid has a plunger (24) which can pass through a hole (26) in a latch mounted on the garage door when the door is closed. The solenoid is mounted so it can be manually moved to an inward position to withdraw the plunger from the latch hole to permit opening of the garage door in the event of a power failure. The solenoid is flexibly mounted so it is not broken free when the plunger is pressed to one side by a vandal or pressed to the opposite side by the door closing when the plunger is extended. An alignment rod (56) which is coupled to the plunger, biases the plunger back towards an orientation in alignment with the plunger-receiving holes in the lock box and latch when sideward pressure in either direction is removed.

5 Claims, 2 Drawing Figures

FIG. 1
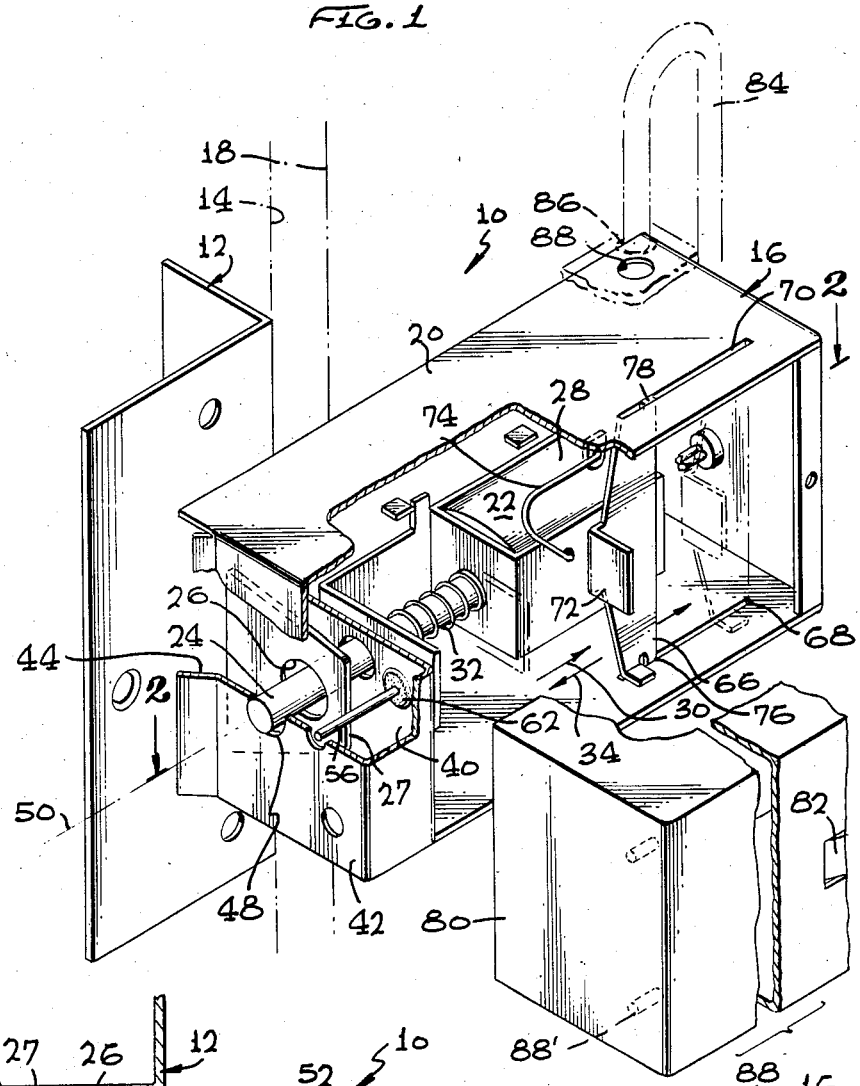
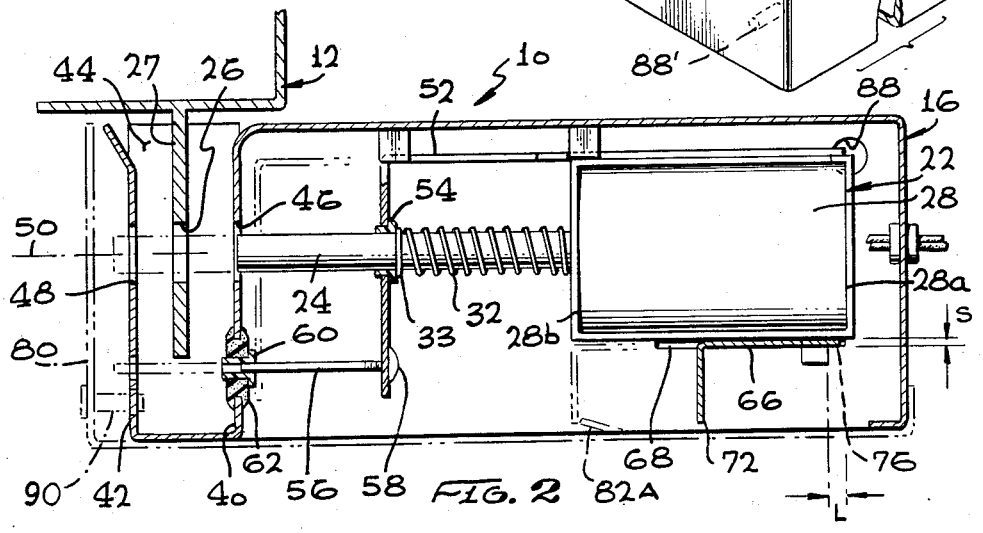
FIG. 2

GARAGE DOOR LOCK SYSTEM

BACKGROUND OF THE INVENTION

One type of system for locking a closed overhead garage door, includes a latch mounted on the garage door and a solenoid mounted on the door frame and having a plunger that passes through a hole in the latch. A system of this type is described in U.S. Pat. No. 4,254,582 by McGee, for Electrically Actuated Overhead Garage Door Opener Assembly. A clearance must be left between the side of a garage door and the door frame, and vandals may try to open or break the lock by tools inserted through the clearance space. One technique is to insert a bolt or other member so its end lies against the plunger, and then hit the bolt with a hammer, in order to break the solenoid loose from its mounting. There is danger that the solenoid will break free, because it must be held sufficiently rigid so the plunger is maintained in alignment with holes in the lock box and latch for normal operation. A load in the opposite direction can occur if the garage door closes when the plunger is extended.

Another problem that must be overcome with such latching systems is to provide for manual opening of the lock in the event of a power failure that prevents energizing of the solenoid to withdraw the plunger. Any arrangement which permits an authorized user to withdraw the plunger in the event of a power failure, should not make the lock vulnerable to withdrawal of the plunger by a vandal. A garage lock system which resisted tampering by vandals or damage from inadvertent door closing, while assuring secure locking and unlocking under normal conditions, and while permitting authorized users to unlock the lock in the event of a power failure, would be of considerable value.

SUMMARY OF THE INVENTION

In accordance with one embodiment of the present invention, a garage door lock system is provided which is especially effective in resisting tampering by vandals or damage from inadvertent garage door closing, and in permitting reliable normal operation and manual opening by authorized persons. The lock system includes a lockbox which can be fastened to a door frame and which supports a solenoid having a plunger. The plunger can pass through the hole in a latch that is fastened to a garage door to lock the door. Under normal operation, when electricity is available to operate the solenoid, the door can be opened by energizing the solenoid to withdraw the plunger from the latch. In one lock system of the invention, the system permits opening of the door in the event of a power failure, by mounting the solenoid so it (and its plunger) can be moved inwardly to manually withdraw the plunger from the latch hole. A cover which is held over the box by a key-operated lock, prevents manual movement of the solenoid to its inward position, except by a person who has a key to open the lock to gain access to the inside of the lock box.

The system is constructed to normally maintain the plunger in alignment with plunger-receiving holes on the lock box and on the latch, while permitting the plunger to deflect against the walls of the plunger-receiving holes without damaging the system. This is accomplished by mounting the solenoid coil so it can change orientation slightly, and by using a means for biasing the plunger towards its initial position in alignment with the plunger-receiving holes when sideward force is removed from the plunger.

The novel features of the invention are set forth with particularity in the appended claims. The invention will be best understood from the following description when read in conjunction with the accompanying drawings.

BRIEF DESCRIPTION OF THE DRAWINGS

FIG. 1 is a partially sectional perspective view of a garage door lock system constructed in accordance with the present invention, with the cover shown removed from the lock box.

FIG. 2 is a sectional view taken on line 2—2 of FIG. 1.

DESCRIPTION OF THE PREFERRED EMBODIMENT

FIG. 1 illustrates a garage door lock system 10 which includes a latch device 12 mounted on a garage door 14 and a lock assembly 16 mounted on a door frame 18. The lock assembly includes a housing in the form of a lock box 20 that carries a solenoid 22. The pin or plunger 24 of the solenoid can pass through a plunger-receiving hole 26 in a plate-like latch 27 of the latch device, to hold the door closed. When a coil 28 of the solenoid is energized, the elongated plunger 24 is moved in an inward direction indicated by arrow 30, against the force of a spring 32, so the plunger withdraws from the latch hole 26 to permit opening of the door. The spring presses against a ring 33 (FIG. 2) that is fixed to the plunger. When the coil is deenergized, the spring 32 urges the plunger in the outward direction indicated by arrow 34, so the plunger can pass through the latch hole. When used with an electric garage door opener, the coil 28 is energized during energization of the motor (not shown) which opens and closed the garage door.

The lock box 20 is constructed of heavy gage steel to securely hold the plunger 24 in position despite tampering by vandals. The lock box includes a pair of spaced locking plates 40, 42 which form an opening 44 between them through which the latch 28 can be received. As shown in FIG. 2, each of the plates has a plunger-receiving hole 46, 48 through which the plunger can pass. The solenoid and plunger-receiving holes 46, 48 are positioned so that the axis 50 of a plunger is aligned with the holes in the initial position of the plunger (when it is not pressed to one side by vandals), so the plunger then does not make contact with the walls of either hole 46, 48. The holes 46, 48 are, of course, sufficiently wider than the plunger to leave clearance around the plunger. It is desirable to leave only a relatively small clearance around the plunger, which is less than the radius of the plunger, especially at the inward hole 46, to minimize the amount by which the plunger can be moved sidewardly before it is stopped by the walls of the hole 46.

In order to permit deflection of the plunger 46 in any direction against the walls of the holes 46, 48, a means is provided for biasing the plunger toward an initial orientation wherein its axis 50 is substantially aligned with the axes of the holes 46, 48, which permits deflection of the plunger away from that position. The biasing means includes a support bracket or guide 52 which carries a bushing or slider bearing 54 that closely surrounds the plunger 24 while permitting the plunger to slide parallel to its axis 50 through the bushing. A rod 56 has an inner end 58 mounted on the guide 52, to hold the rod in a fixed position and orientation relative to the guide. The rod extends through a rod slider bearing 60 which is held by a rubber grommet 62 on the locking plate 40. The rod 56 biases the plunger 24 toward its initial position wherein its axis 50 is aligned with the holes 46, 48. However, if the plunger 24 is pressed to one side, the guide 52 and rod 56 will also be moved to that side. The rubber grommet 62 permits the rod 56 to be deflected to one side, but when the deflecting force is removed the grommet urges the rod 56 towards its initial position to thereby urge the plunger 24 towards its initial position. Thus, while the plunger 24 will always seek its initial position wherein it is aligned with the holes 46, 48, the plunger can withstand deflection agsinst the walls of the holes 46, 48 by vandals or by the garage door inadvertently closing so latch 27 strikes the extended plunger. When the deflection force is removed, the plunger will return to its initial position. The guide 52 is mounted on the coil end of the solenoid 32.

It is desirable to permit unlocking of the lock system 10 in the event of a power failure, to permit opening and closing of a garage door by manual means. To permit unlocking, the solenoid 22 is mounted on a bracket 66 which can slide along a pair of slots 68, 70 (FIG. 1) that are formed in the lock box and that extend parallel to the axis 50 of the plunger. The bracket includes a handle 72 that can be grasped by the hand of a person to move the solenoid inward and outward against the force of an over-center spring 74 that retains the solenoid in the inward or outward position to which it has been moved. The bracket 66 includes legs 76, 78 which lie within the slot 68, 70. The length L (FIG. 2) of each leg portion which lies in a slot, is less than 5 times the width S of the slot so that the bracket can pivot by a limited angle within the slot to permit slight deflection of the axis 50 of the plunger from its initial position, when it is moved against the walls of plunger-receiving holes 46, 48. The legs 76, 78 of the bracket lie at the inward end **28*a* of the solenoid, which is opposite its outward end 28*b*, so they experience minimum twisting for a given sideward movement of the solenoid plunger against a wall of the plunger-receiving holes such as 46. The hole 46 in the innermost plate 40 is slightly smaller in diameter than the hole 48** in the outer plate, so that when the plunger is pushed against the walls of the holes and the solenoid pivots, the plunger contacts both hole walls to avoid sideward loading of the solenoid.

A cover 80 is provided to prevent unauthorized persons from moving the bracket 66 rearwardly to retract the plunger from the latch 28. The cover includes a stop 82 that fits immediately behind the handle 72, as shown at 82A in FIG. 2, so that when the solenoid is in its outward position wherein it can be used to lock the garage door, the solenoid cannot be moved rearwardly unless the cover 80 is first removed. The cover is held in place over the lock box by a bicycle padlock 84 whose shackle fits through a hole 86 formed in the top and bottom walls of the cover near one corner thereof, and through holes 88 in the lock box. When the solenoid is moved to its inward position shown in FIG. 2, so it is inoperative to lock the garage door, the solenoid coil prevents the padlock shackle from passing through the holes 88 so the cover cannot be locked in the unlock position. The cover has a pair of pins 90 that are received in holes in the lock box plate 42, so the cover can be pivoted around the pins to a closed position and then padlocked in place.

Thus, the invention provides a garage door lock system which resists tampering by vandals when the lock is closed on a garage door latch, and yet which permits easy opening of the lock by authorized persons in the event of a power failure. Forces applied by a vandal to the plunger to deflect it sidewardly, are resiliently resisted so the plunger can be deflected until it is supported by the walls of plunger-receiving holes without the coil breaking loose from the bracket. A biasing means biases the plunger back towards its initial position of alignment with the holes when the sideward forces are removed. The solenoid which includes the plunger, can be manually moved inwardly to withdraw the plunger from the latch.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A garage door lock system for locking a garage door to the door frame, and resisting attempts by vandals to unlock the door from the door frame, comprising:

a latch device which is mountable on a garage door and which has a latch with a latch hole;

a lock box which can be fastened to said door frame, said box having a pair of spaced plates and an opening for receiving the latch between the plates, each plate having walls forming a plunger-receiving hole which is wider than said plunger and said plunger-receiving holes being aligned so that when the latch lies between the plates, a plunger can pass through both plunger-receiving holes and the hole in the latch;

a solenoid which includes an energizeable coil with a plunger axis and a plunger extending along said plunger axis in an outward direction from said coil and through said latch hole and plunger-receiving holes when the coil is unenergized, said coil deflecting when said plunger is deflected perpendicular to said axis; and means mounting said coil to said lock box to resiliently bias said coil toward an initial orientation at which said plunger is away from contact with the walls of said plunger-receiving holes, but permitting said plunger to be deflected by vandals against any portion of the walls of a plunger-receiving hole, and returning said coil to said initial orientation when no longer deflected by vandals.

2. The system described in claim 1 including:

a door which is moveable between closed and open positions, and said latch device is mounted on a door location which moves in first and second directions as the door moves towards its closed and open positions;

said coil has inward and outward ends, said inward end being further from said plates than said outward end, and said mounting means pivotally supports the inward end of said coil on said lock box to allow the plunger to move substantially parallel to said first and second directions, whereby to minimize the angle of misalignment of the axis of the plunger from an initial orientation when the plunger is pressed against the wall of at least one of the plunger-receiving holes.

3. A door lock system for locking a door to the door frame, comprising:

a latch device which is mountable on a door and which has a latch with a latch hole;

a lock box which can be fastened to said door frame, said box having a pair of spaced plates and an opening for receiving the latch between the plates, each plate having walls forming a plunger-receiving hole which is wider than said plunger and said plunger-receiving holes being aligned so that when the latch lies between the plates, a plunger can pass through both plunger-receiving holes and the hole in the latch;

a solenoid which includes an energizeable coil with a plunger axis and a plunger extending along said plunger axis in an outward direction from said coil and through said latch hole and plunger-receiving holes when the coil is unenergized; and means mounting said coil to bias it toward an orientation at which said plunger is away from contact with the walls of said plunger-receiving holes, but permitting said plunger to be biased against the walls of a plunger-receiving hole;

said mounting means includes walls forming a pair of slots in opposite walls of said lock box that extend parallel to the plunger axis, and a bracket fixed to said coil and having opposite ends that are slideably disposed in said slots;

the portion of each end of said bracket which lies in a slot having a length parallel to said axis which is less than five times the width of the slot, whereby to permit limited pivoting of the coil and therefor of the plunger.

4. In a door lock system which includes a lock box fixed to a door frame and having walls forming a plunger-receiving hole, a solenoid having a coil and mounted in said box and an elongated plunger that is slideable along said coil and that can pass along a plunger axis through the plunger-receiving hole in the lock box and through the location of a latch hole when the door is closed to thereby hold the door closed, the improvement comprising:

means for mounting said solenoid on said lock box so the solenoid can be manually moved parallel to its axis between an outward position at which the plunger can pass through the latch hole location and an inward position at which the plunger is withdrawn from the latch hole location;

handle means mounted on said solenoid for moving it between said outward and inward positions; and means for retaining said solenoid in said outward position when moved thereto;

said means for mounting said solenoid on said lock box is constructed to allow the coil to change orientation to permit the plunger to press against the walls of the plunger-receiving hole without the solenoid breaking loose from said lock box;

a guide attached to said solenoid and having a plunger slider bearing which closely receives said plunger;

an alignment rod mounted on said guide to extend parallel to the length of said plunger;

a rod slider bearing slideably holding said rod; and a mount of elastomeric material which holds said rod slider bearing on said lock box, said mount constructed to bias said rod slider bearing toward a predetermined position wherein it holds said guide so that said plunger is away from the walls of said plunger-receiving hole, but said mount permitting resilient deflection of said rod to permit the plunger to be pressed against the walls of said plunger-receiving hole, whereby to enable the plunger and coil to withstand attempts by a vandal to deflect the plunger sidewardly while returning the plunger to a position aligned with the plunger-receiving hole when the plunger is not deflected by a vandal.

5. In a door lock system which includes a lock box fixed to a door frame and having a plunger-receiving hole, a solenoid having a coil mounted on said box and an elongated plunger that can pass along a plunger axis through the plunger-receiving hole in the lock box and through the location of a latch hole when the door is closed to thereby hold the door closed, the improvement wherein:

said solenoid is mounted on said lock box so it can be manually moved parallel to its axis between an outward position at which the plunger can pass through the latch hole location and an inward position at which the plunger is withdrawn from the latch hole location;

handle means mounted on said solenoid for moving it between said outward and inward positions;

said lock box has an opening providing access to said solenoid and handle; and a cover which fits closely over said lock box opening to prevent access to said solenoid and handle and which locks to said lock box, said cover having a stop which prevents movement of said solenoid from said outward position to said inward position when the cover is on the lock box.

* * * * *